US005651700A

United States Patent [19]

Sato et al.

[11] Patent Number: 5,651,700

[45] Date of Patent: Jul. 29, 1997

[54] ELECTRICAL CONNECTOR

[75] Inventors: Kensaku Sato; Akira Shirai, both of Tokyo, Japan

[73] Assignee: Hirose Electric Co., Ltd., Tokyo, Japan

[21] Appl. No.: 528,499

[22] Filed: Sep. 14, 1995

[30] Foreign Application Priority Data

Sep. 27, 1994 [JP] Japan ..... 6-256138

[51] Int. Cl.[6] ..... H01R 13/40

[52] U.S. Cl. ..... 439/595

[58] Field of Search ..... 439/595, 744

[56] References Cited

U.S. PATENT DOCUMENTS 4,784,617 11/1988 Oda ..... 439/595
4,944,696 7/1990 Sueyoshi et al. ..... 439/595
4,969,841 11/1990 Sueyoshi et al. ..... 439/595
5,328,382 7/1994 Pawlicki ..... 439/273

FOREIGN PATENT DOCUMENTS 0374492 6/1990 European Pat. Off. .
5089922 4/1993 Japan .

*Primary Examiner*—Neil Abrams
*Assistant Examiner*—Barry Matthew L. Standig
*Attorney, Agent, or Firm*—Kanesaka & Takeuchi

[57] ABSTRACT

An electrical connector includes a female terminal 31 engaged with a lance 40 of the connector housing 3 and having a contact portion 46 and a retainer latch shoulder 60 and a retainer 32 having a wedge member 55 for urging the lance 40 against the terminal and a retainer lance 54 for engagement with the retainer latch shoulder 60 of the female terminal 31.

2 Claims, 15 Drawing Sheets

ELECTRICAL CONNECTOR

BACKGROUND OF THE INVENTION

1. Field of the Invention

The present invention relates to electrical connectors for use in electrical equipment.

2. Description of the Prior Art

A conventional electrical connector includes a connector housing with a terminal receiving cavity having a lance and a terminal placed in the receiving cavity such that the lance engages the shoulder of the terminal to secure the terminal.

However, in the above connector there is an occasion that the terminal falls off from the housing.

SUMMARY OF THE INVENTION

Accordingly, it is an object of the invention to provide an electrical connector capable of securing a terminal without failure.

According to the invention there is provided an electrical connector which includes a connector housing with a front retainer receiving cavity and a rear terminal receiving cavity having a lance; a terminal with a lance shoulder placed in the terminal receiving cavity such that the lance shoulder engages the lance and having a retainer latch shoulder; and a retainer with a latch projection placed in the retainer receiving cavity such that the retainer urges the lance against the terminal while the latch projection engages the retainer latch shoulder of the terminal thereby providing a double engagement for the terminal.

It is preferred that the retainer includes a wedge member for urging the lance against the terminal and a latch projection for engaging the retainer latch shoulder of the terminal.

The terminal is latched by the lance of the housing while the lance is pressed against the terminal by the retainer while the latch projection of the retainer engages the retainer latch shoulder of the terminal, thus providing a double engagement which assures the fixation of the terminal.

When two connectors are connected, the retainer is pushed into the connector housing so that the wedge member of the retainer urges the lance against the terminal, thus assuring the fixation of the terminal.

The above and other objects, features, and advantages of the invention will be more apparent from the following description when taken in conjunction with the accompanying drawings.

BRIEF DESCRIPTION OF THE DRAWINGS

FIG. 8(2) is a view as viewed from arrow D of FIG. 8(1);

FIG. 9(2) is a side view of the inner seal;

FIG. 9(3) is a sectional view taken along line E—E of FIG. 9(1);

FIG. 9(4) is an enlarged view of an area F of FIG. 9(1);

DESCRIPTION OF THE PREFERRED EMBODIMENT

Figure 1:
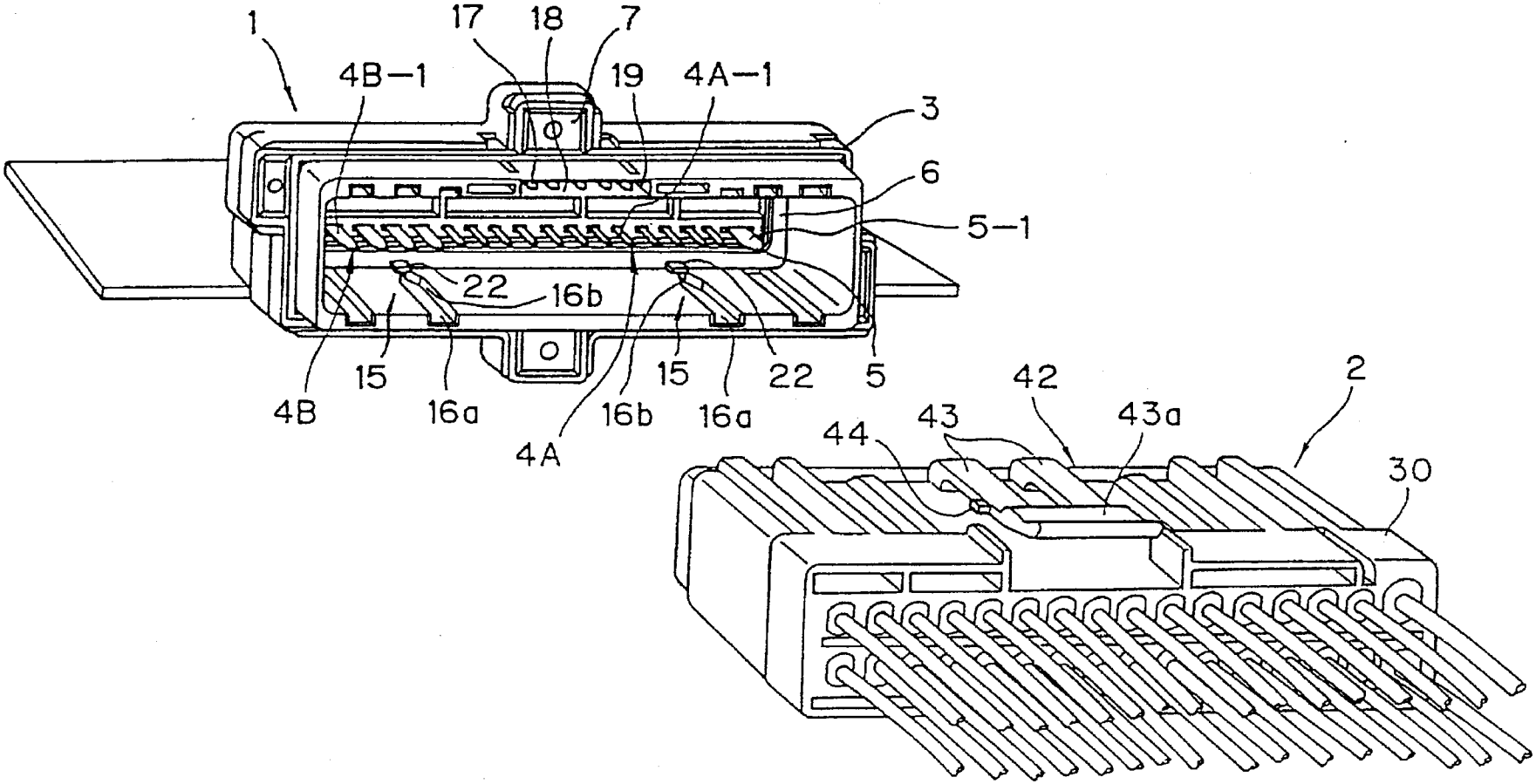
FIG. 1 is a perspective view of male and female connectors before connection.
Figure 2:
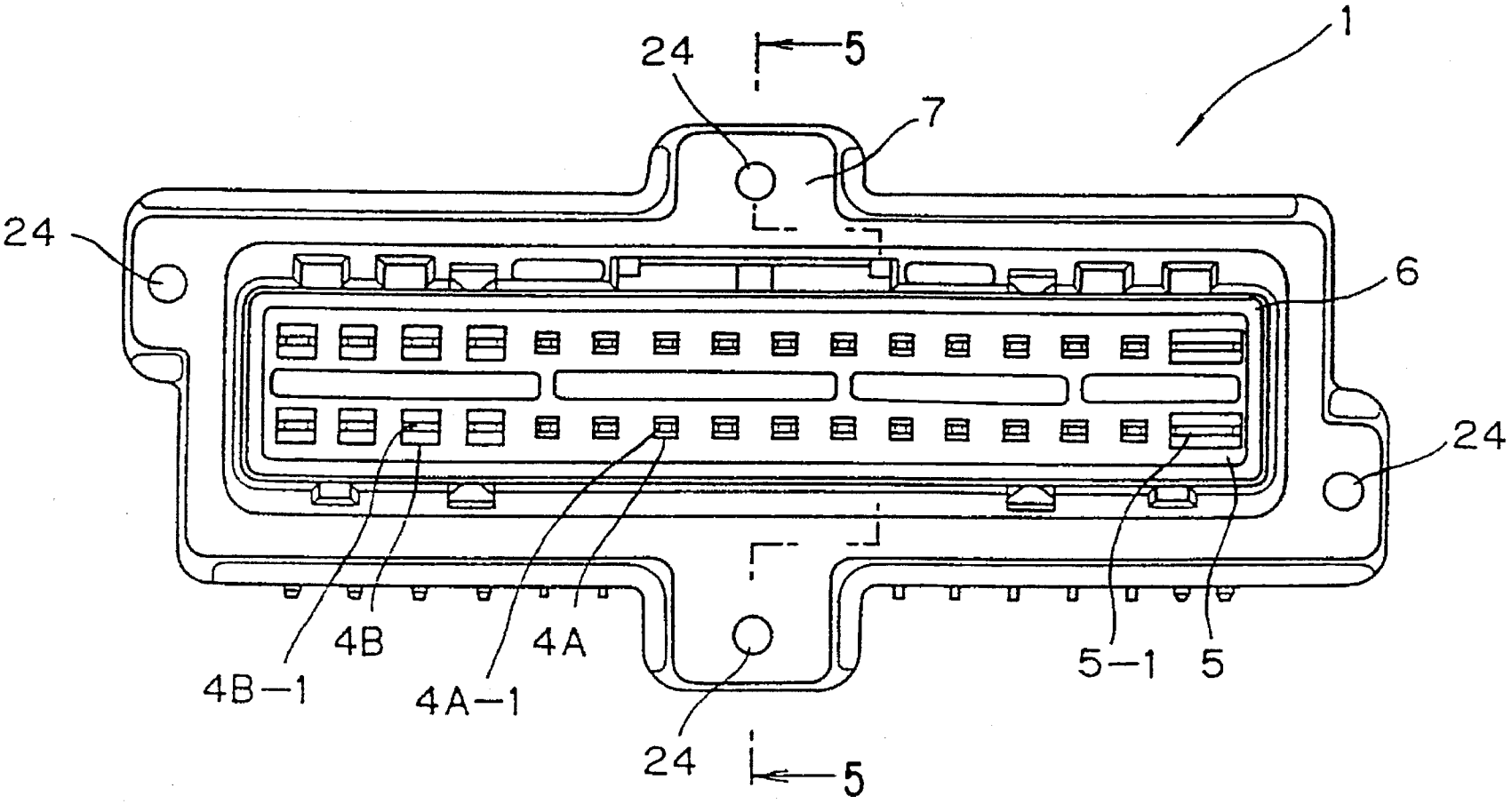
FIG. 2 is a front view of the male connector.
Figure 3:
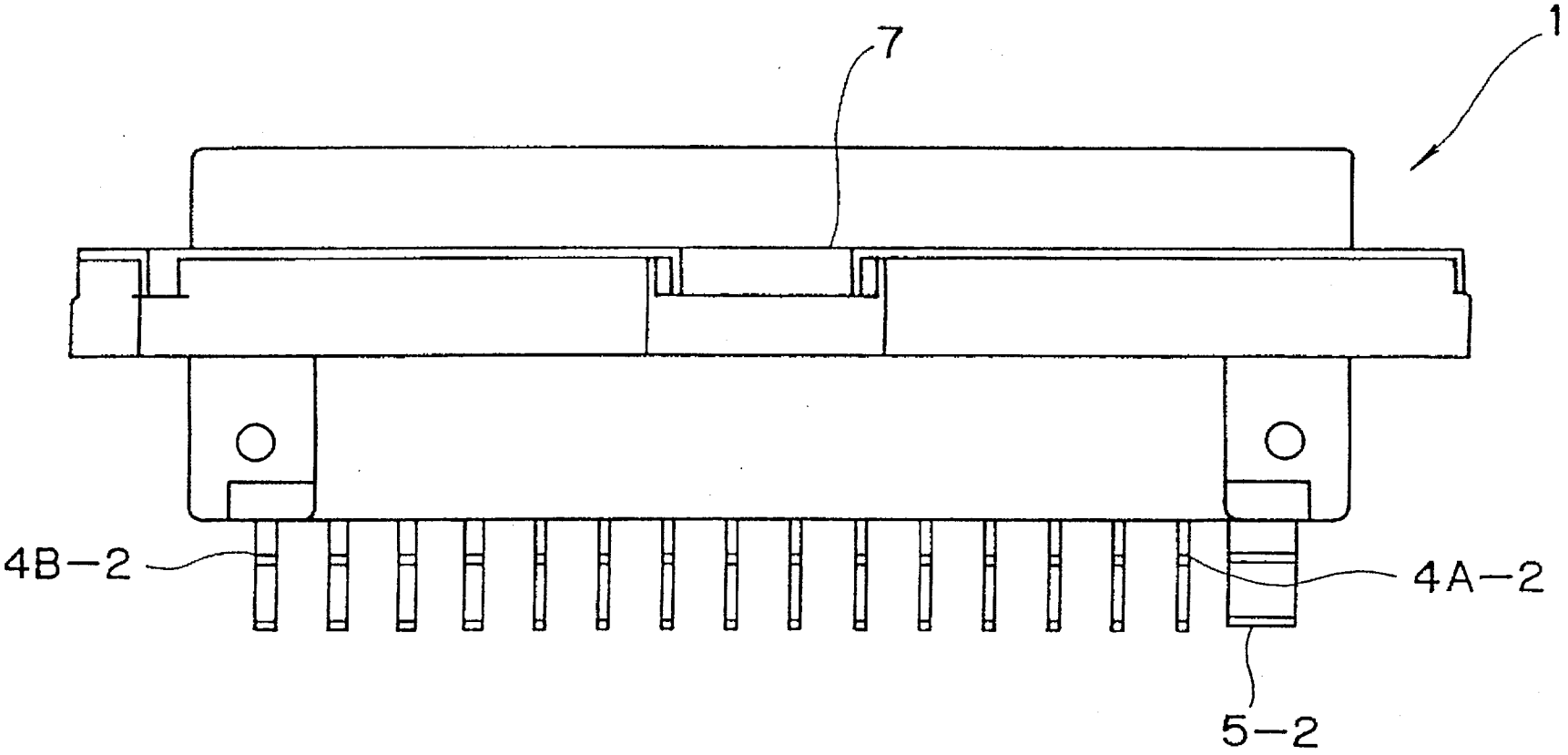
FIG. 3 is a top plan view of the male connector.
Figure 4:
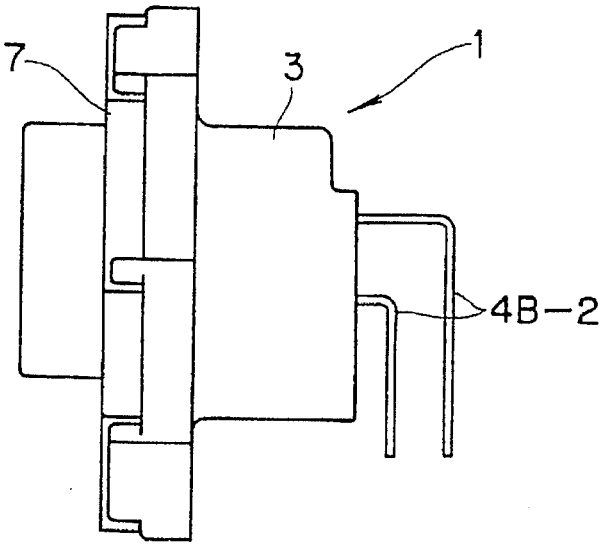
FIG. 4 is a side view of the male connector.
Figure 5:
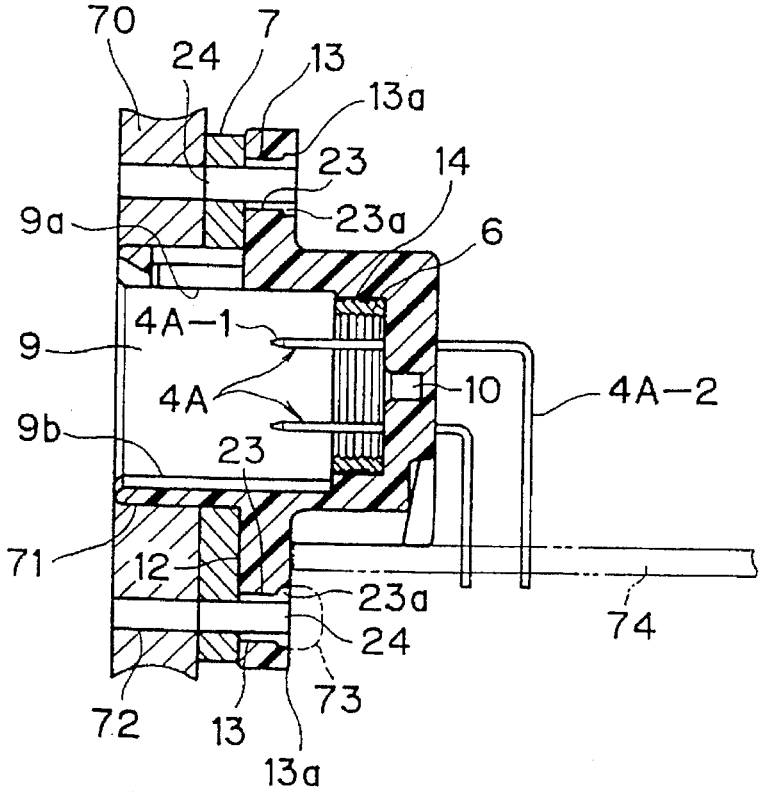
FIG. 5 is a sectional view taken along line A—A of FIG. 2.

FIG. 1 is a perspective view of male and female connectors before connection; FIG. 2 is a front view of the male connector; FIG. 3 is a top view of the male connector; 4 is a side view of the male connector; and FIG. 5 is a sectional view taken along line 5—5 of FIG. 2.

The electrical connector assembly consists of a male connector 1 and a female connector 2. The male connector 1 includes a connector housing 3, a number of male signal terminals 4A and 4B, male power terminals 5, and inner and outer seals 6 and 7.

Figure 6:
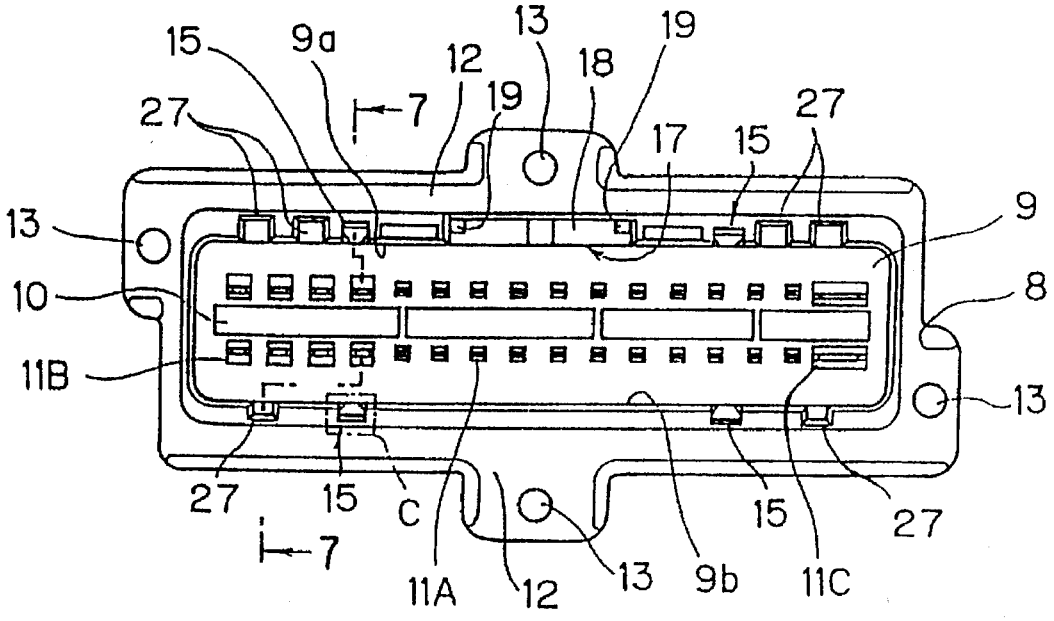
FIG. 6 is a front view of a connector housing for the male connector.
Figure 7:
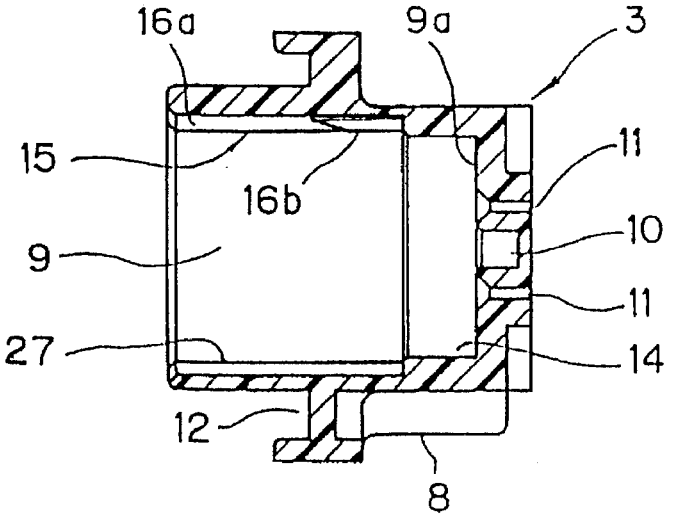
FIG. 7 is a sectional view taken along line B—B of FIG. 6.
Figure 8A:
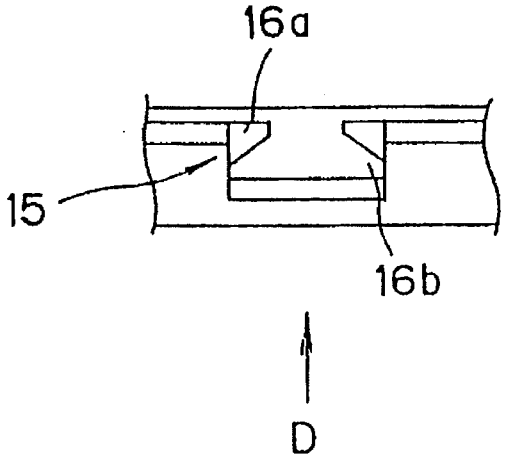
FIG. 8(1) is an enlarged view of an area C of FIG. 6.
Figure 8B:
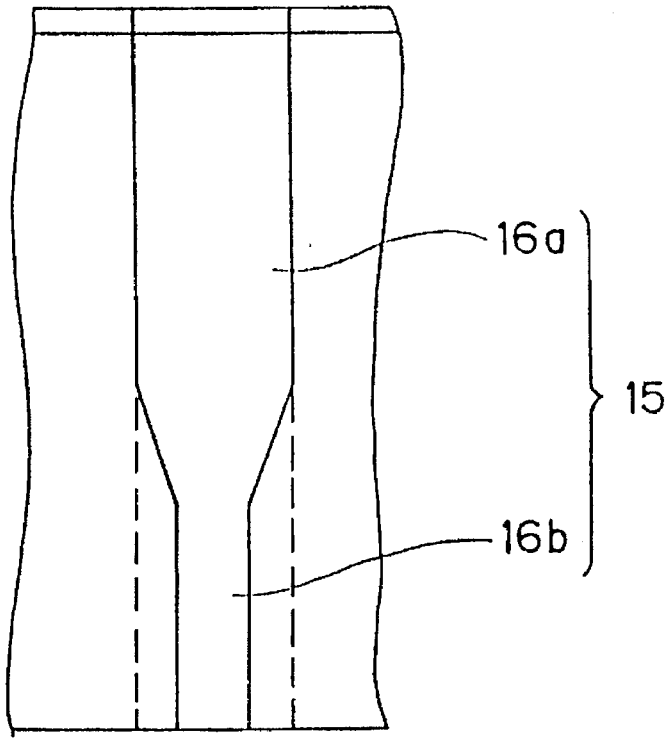
Figure 9A:
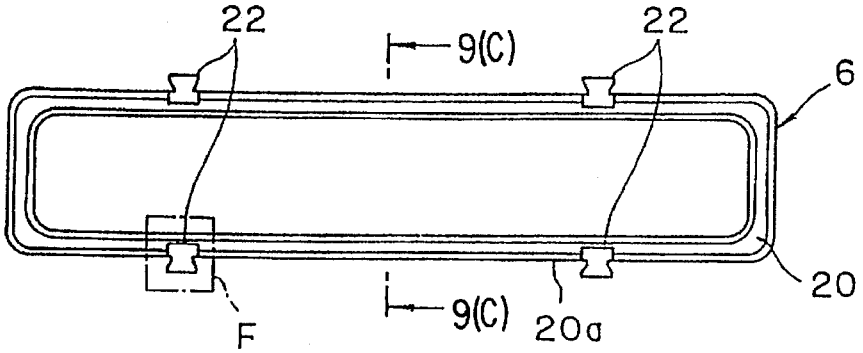
FIG. 9(1) is a top view of an inner seal for the male connector.
Figure 9B:
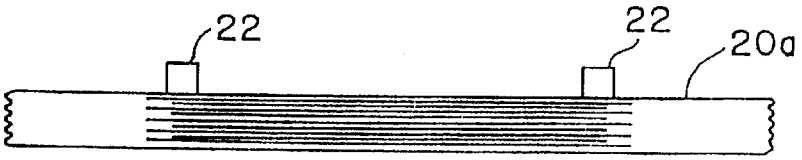
Figure 9C:
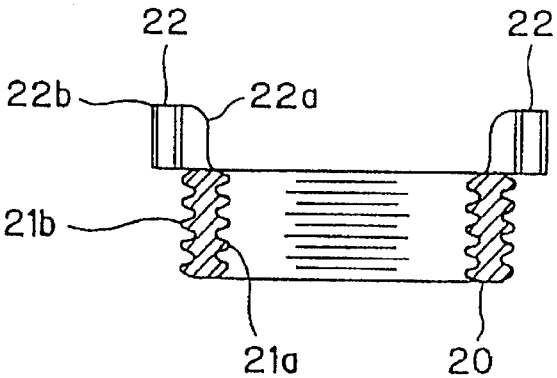
Figure 9D:
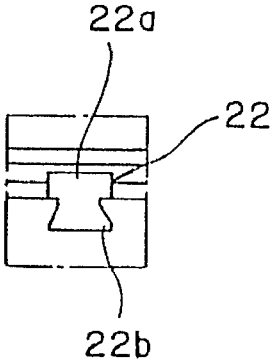
Figure 10:
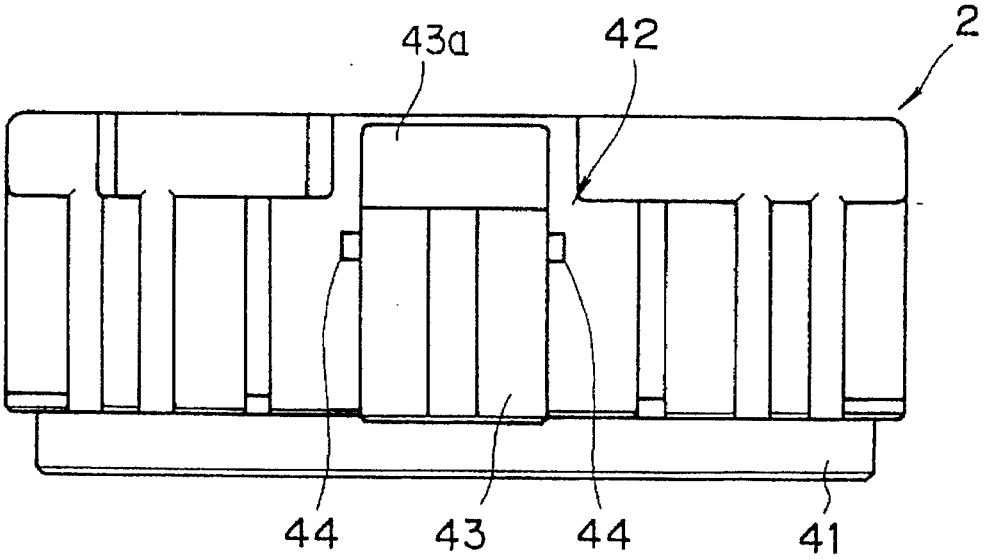
FIG. 10 is a top view of the female connector.
Figure 11:
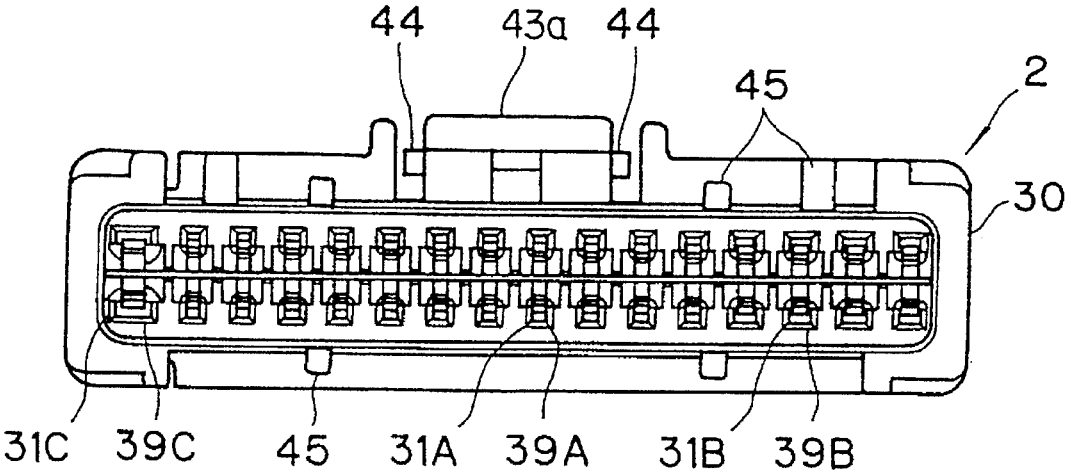
FIG. 11 is a front view of the female connector.
Figure 12:
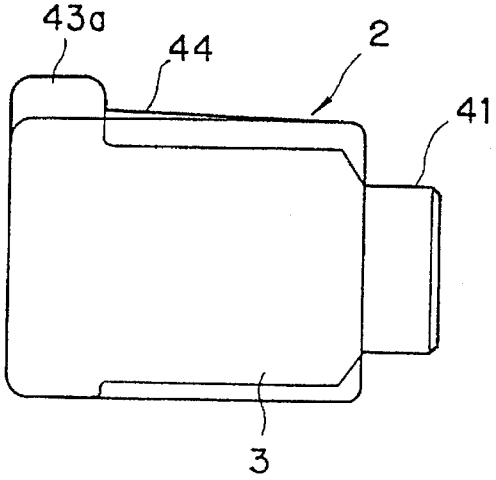
FIG. 12 is a side view of the female connector.

In FIGS. 6 and 7, the connector housing 3 has a rectangular housing body 8 with a fitting recess 9. Retainer receiving recesses 10 are provided along the center line of a rear wall 9*a*. Terminal receiving apertures 11A, 11B, and 11C are provided along the retainer receiving recesses 10 to receive male signal terminals 4A and 4B, and male power terminals 11C, respectively.

An outer seal receiving groove 12 is provided along the circumference of the connector housing 3. Fixing apertures 13 with a shoulder 13*a* are provided in the receiving groove 12 on upper, lower and opposite side positions. An inner seal mounting section 14 is provided on the rear portion of the fitting recess 9.

Seal latch members 15 are provided on the upper and lower walls 9*a* and 9*b* of the fitting recess 9. Each seal latch member 15 is made up of an insertion channel 16*a* and a dovetail latch groove 16*b*. Also, guide channels 27 are provided on the upper and lower walls of the fitting recess 9.

A male lock 17 is provided at the center of the upper wall 9*a* of the fitting recess 9. The male lock 17 is made up of an insertion channel 18 and a pair of lock projections 19 on opposite sides of the insertion channel 18.

In FIG. 9, the inner elastic seal 6 has an annular seal body 20 along the periphery of the fitting recess 9. A plurality of lip members 21*a* and 21*b* are provided on inner and outer surfaces of the seal body 20. Latch projections 22 are provided on a front face 20*a* of the seal body 20 at upper and lower positions. Each latch projection 22 is made up of a support member 22*a* extending from the front face 20*a* and a latch member 22*b* extending outwardly from the support member 22*a*, providing a dovetail cross section.

The outer elastic seal 7 has a shape similar to that of the seal receiving groove 12 and latch projections 23 with a latch tip 23*a* at upper, lower and opposite side positions. A bolt hole 24 is provided in the latch projection 23 (see FIG. 5).

The male signal terminals 4A and 4B and the male power terminals 5 are placed in the terminal receiving apertures 11A, 11B, and 11C, respectively, such that the contact portions 4A-1, 4B-1, and 5-1 are exposed in the fitting recess while the terminal legs 4A-2, 4B-2, and 5-2 extend rearwardly from the connector housing 3.

The inner elastic seal 6 is placed on the seal mounting section 14 in the rear portion of the fitting recess 9 such that the latch dovetails 22*b* of the latch projections 22 are engaged with the latch dovetail grooves 16*b* of the seal latch members 15 under compressed conditions.

The elastic outer seal 7 is placed in the seal mounting groove 12 such that the latch projections 23 of the outer seal 7 are inserted in the fixing apertures 13 of the housing so that the latch tips 23*a* engage the latch shoulders 13*a* to form the male connector 1.

The female connector 2 includes a connector housing 30, a female terminals 31, a retainer 32, and an elastic seal 33.

Figure 13:
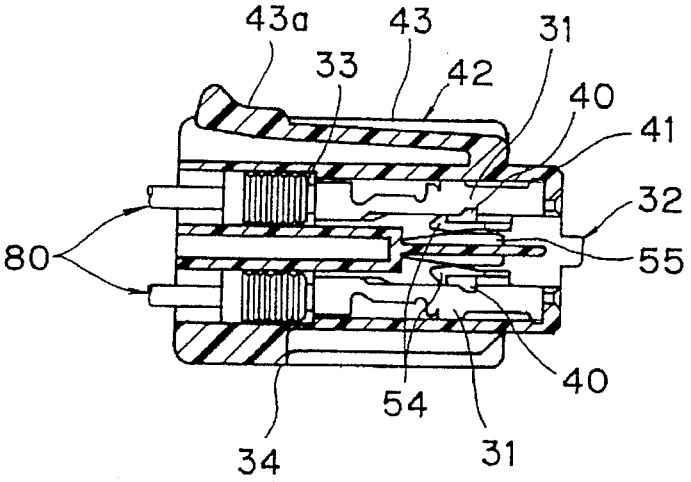
FIG. 13 is a sectional view of the female connector.
Figure 14:
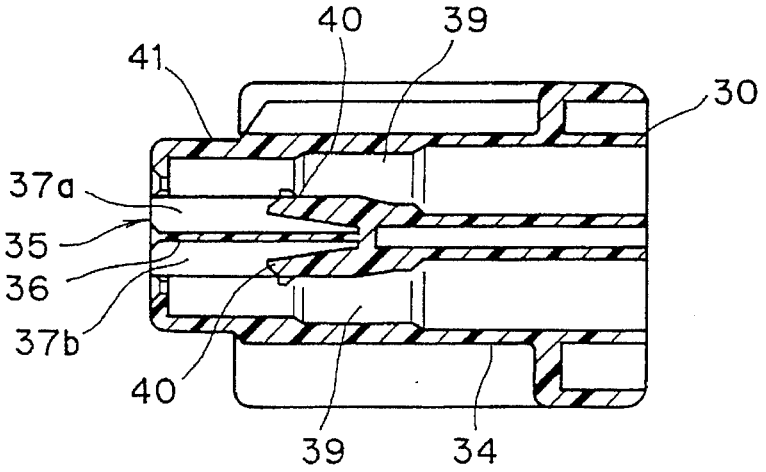
FIG. 14 is a sectional view of a connector housing for the female connector.

In FIGS. 13 and 14, the connector housing 30 has a rectangular housing body 34 with a front fitting section 41. Retainer receiving section 35 is provided on the front face of the fitting section 41. Insertion holes 37*a* and 37*b* are provided in the retainer receiving section 35 on opposite sides of a central partition wall 36. Terminal receiving cavities 39 are provided in the housing body 34. The terminal receiving cavities 39 include receiving cavities 39A and 39B for female signal terminals and 39C for female power terminals. A lance 40 is provided on each terminal receiving cavity 39 on the side of a separation wall 38.

A female lock 42 is provided on the top of the connector housing 30. The female lock 42 is made up of a cantilever lock lever 43, a pair of lock projections 44 on the lock lever 43 and a release button 43a on the tip of the lock lever 43. Guide sections 45 are provided on upper and lower outside of the connector housing 30.

Figure 15A:
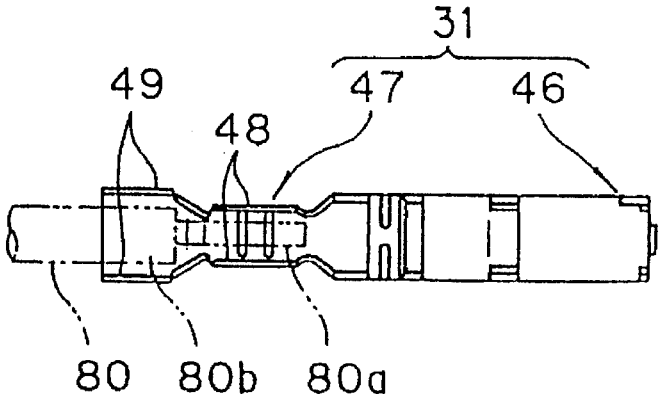
FIG. 15(A) is a top view of a female terminal.
Figure 15B:
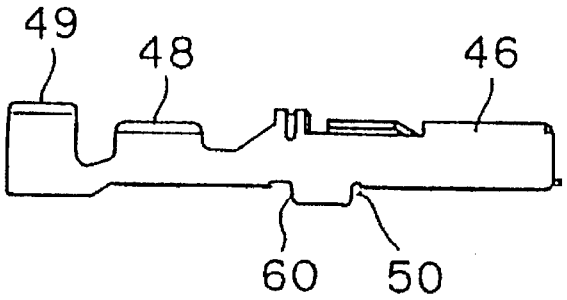
FIG. 15(B) is a side view of the female terminal.
Figure 15C:
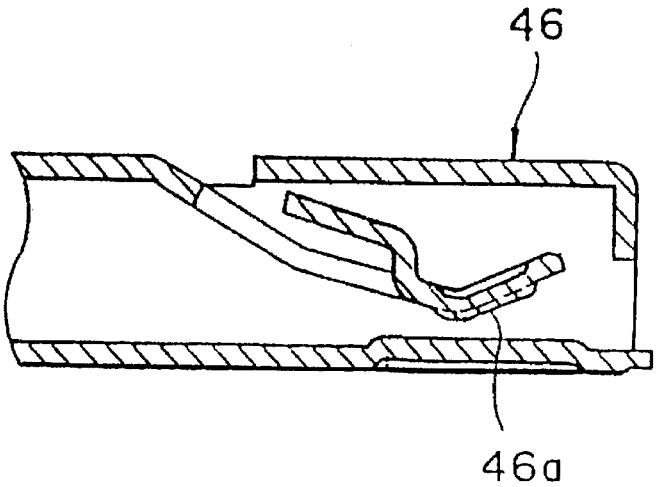
FIG. 15(C) is a sectional view of a contact portion of the female terminal.
Figure 16A:
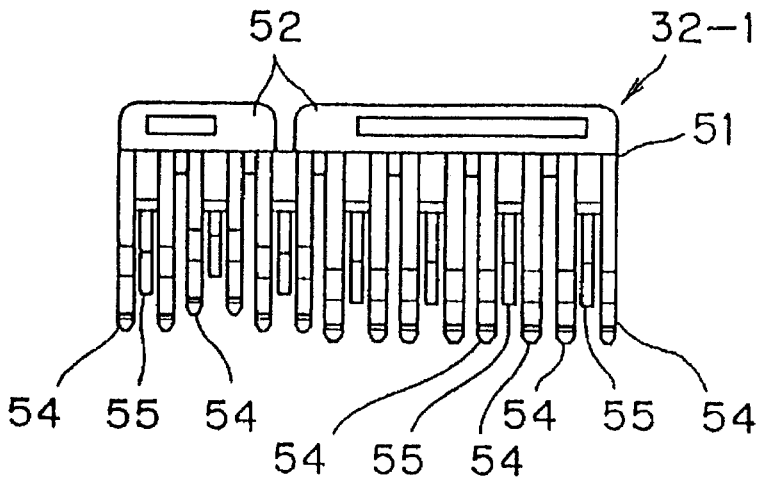
FIG. 16(A) is a top view of a first retainer.
Figure 16B:
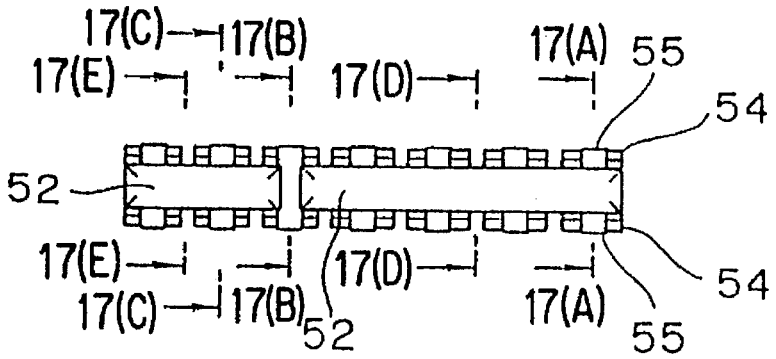
FIG. 16(B) is a front view of the first retainer.
Figure 16C:
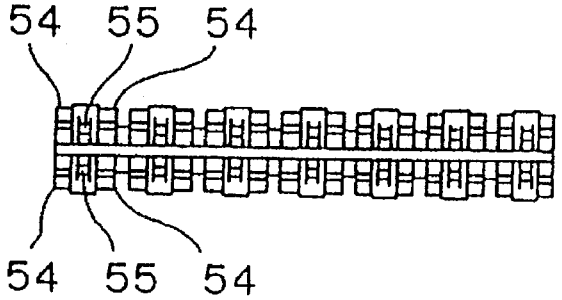
FIG. 16(C) is a rear view of the first retainer.
Figure 16D:
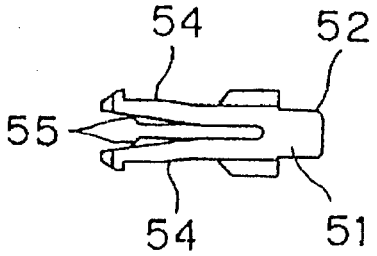
FIG. 16(D) is a side view of the first retainer.
Figure 17A:
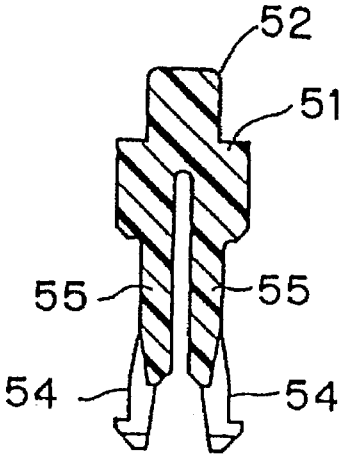
FIG. 17(A) is a sectional view taken along line 17(A)—17(A) of FIG. 16(B)
Figure 17B:
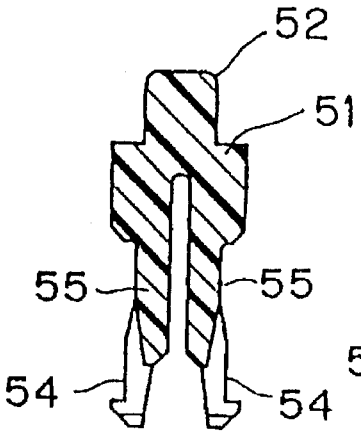
FIG. 17(B) is a sectional view taken along line 17(B)—17(B) of FIG. 16(B)
Figure 17C:
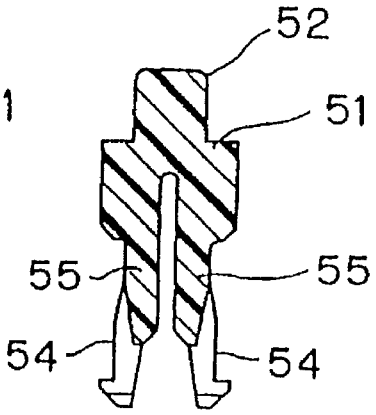
FIG. 17(C) is a sectional view taken along line 17(C)—17(C) of FIG. 16(B)
Figure 17D:
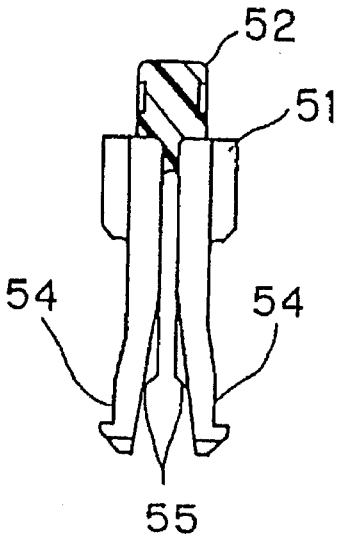
FIG. 17(D) is a sectional view taken along line 17(D)—17(D) of FIG. 16(B)
Figure 17E:
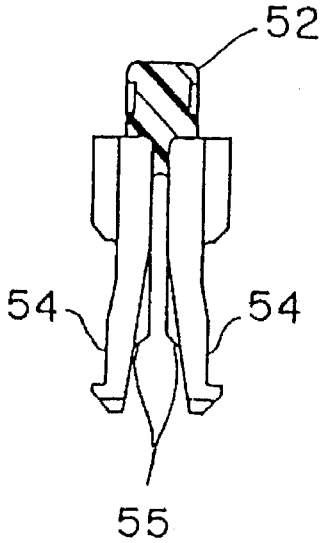
FIG. 17(E) is a sectional view taken along line K—K of FIG. 16(B)

In FIG. 15, the female terminal 31 has a contact section 46 and a crimping section 47. A lance shoulder 50 and a retainer shoulder 60 are provided between the contact and crimping sections 46 and 47. The contact section 46 has a tubular form and has a contact tongue 46*a* therein. The crimping section 47 has a pair of core wire crimping tabs 48 and a pair of jacket crimping tabs 49. The female terminals 31 includes female signal terminals 31A and 31B, and female power terminals 31C. The core wire crimping tabs 48 are crimped on the core wire 80*a* while the jacket crimping tabs 49 are crimped on the jacket 80*b* to secure the cable 80.

Figure 18A:
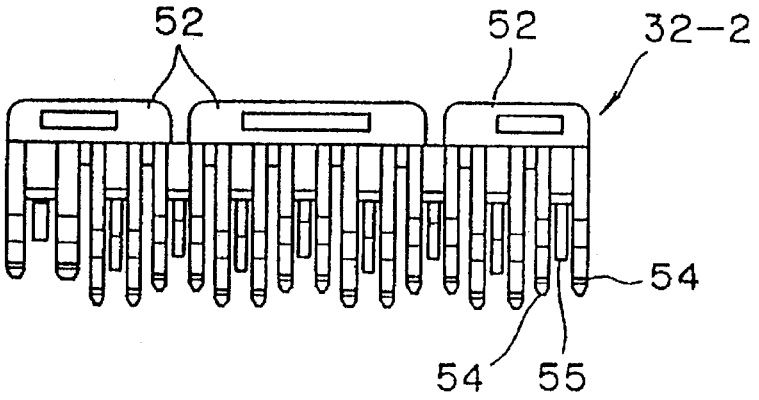
FIG. 18(A) is a top view of a second retainer.
Figure 18B:
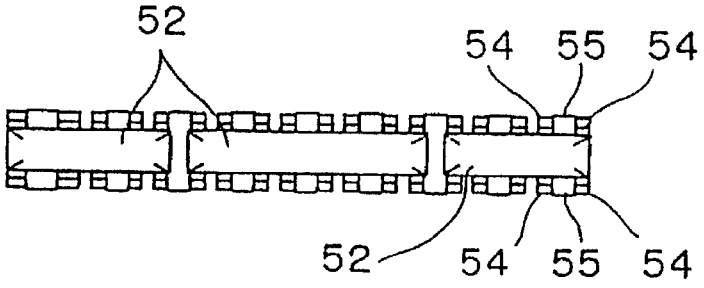
FIG. 18(B) is a front view of the second retainer.

The retainer 32 is made up of a first retainer 32-1 as shown in FIGS. 16 and 17 and a second retainer 32-1 as shown in FIG. 18. The first retainer 32-1 has a retainer body 51 with two protruded sections 52 on the front end. A plurality of sets, each set having a pair of retainer lances 54, a pair of wedges 55, and a pair of retainer lances 54, are provided on the rear end of the retainer body 51 at regular pitch.

Similarly, the second retainer 32-2 has a retainer body 51 with three protruded sections 52 on the front end. A plurality of sets, each set having a pair of retainer lances 54, a pair of wedges 55, and a pair of retainer lances 54, are provided on the rear end of the retainer body 51 at regular pitch.

Figure 19A:
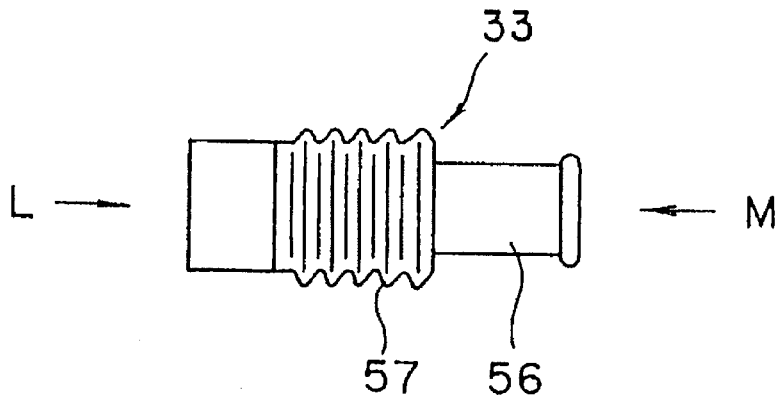
FIG. 19(A) is a top view of an elastic seal.
Figure 19B:
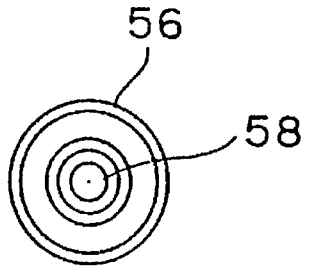
FIG. 19(B) is a view as viewed from arrow L of FIG. 19 (1)
Figure 19C:
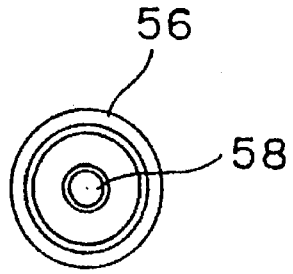
FIG. 19(C) is a view as viewed from arrow M of FIG. 19(1)
Figure 20:
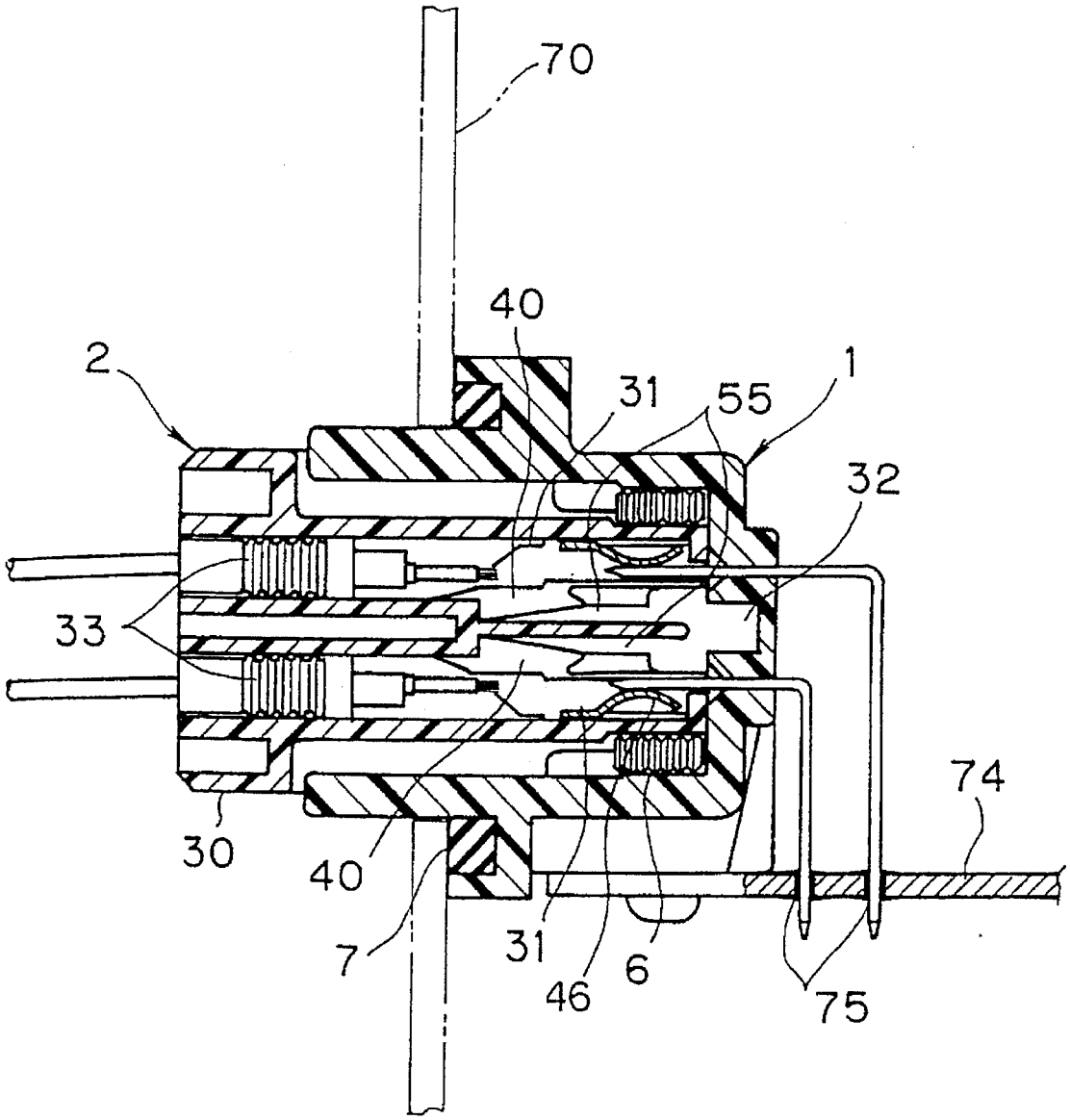
FIG. 20 is a sectional view of the male and female connectors as connected.

In FIG. 19, the elastic seal 33 has a tubular seal body made from rubber and having a central through hole 58 therein and a plurality of lip members 57 on the middle area.

A cable 80 is inserted through the through hole 58 of the elastic seal 33 to attach the elastic seal to the cable 80. The female terminal 31 connected to the cable 80 is inserted into the receiving cavity 39 of the connector housing 30 such that the lance 40 engages the lance shoulder 50. The female signal terminals 31A and 31B and the female power terminals 31C are placed in the receiving cavities 39A, 39B, and 39C, respectively. The elastic seal 33 is placed in the rear portion of the terminal cavity 39 in a watertight fashion.

The first and second retainers 32-1 and 32-2 are placed in the retainer receiving cavities 35 of the fitting section 41 such that the wedges 55 of the first and second retainers 32-1 and 32-2 are placed in the upper and lower insertion apertures 37*a* and 37*b* on opposite sides of the central partition wall 36, urging the lance 40 against the female terminal 31 thus assuring the engagement between the lance 40 and the lance shoulder 50. The lances 54 of the first and second retainers 32-1 and 32-2 are placed in the insertion apertures 37*a* and 37*b* and engaged with the retainer shoulder 60 of the female terminal 31 forming the female connector 2.

The wedges 55 of the first and second retainers 32-1 and 32-2 are placed between the partition wall 36 and the lance 40 urging the lance against the female terminal 31. The lances 54 of the first and second retainer 32-1 and 32-2 are placed in the receiving cavities 37*a* and 37*b* and engaged with the retainer shoulders 60 of the female terminal 31, thus assuring the placement of the female terminal 31 in the receiving cavity 39 (double engagement).

As shown in FIG. 5, the male connector 1 is mounted on a panel 70. A mounting opening 71 and threaded hole 72 are provided in the panel 70. The front portion of the male connector 1 is placed in the opening 71 such that the outer elastic seal 7 abuts against the panel 70 when the male connector 1 is mounted on the panel 70 by screwing bolts 73 into the threaded hole 72. A printed circuit board 74 is attached to the male connector 1 such that the terminal legs of the respective terminals are connected to the through holes 75 of the printed circuit board 74.

How to connect and disconnect the male and female connectors will be described below.

The front portion of the female connector 2 is fitted into the fitting recess 9 of the male connector 1 such that the fitting section 41 of the female connector 2 is fitted in the retainer receiving recess 10 of the male connector 1 so that the contact portions 4A-1, 4B-1, and 5-1 of the male terminals 4A, 4B, and 5 are brought into contact with the contact portions 46 of the female terminal 31. At the same time, the lock lever 43 of the female lock 42 is placed in the lock channel 18 of the male lock 17 such that the latch projections 44 engage the latch members 19 to lock the male and female connectors 1 and 2 together. The front end of the female connector 2 is pressed against the inner elastic seal 6 to make the interior waterproof.

To disconnect the male connector 1 from the female connector 2, the release button 43*a* is depressed to deflect the lock lever 43 so that the latch projections 44 are released from the latch members 19 thereby permitting the male connector 1 to be pulled out of the female connector 2.

As has been described above, the connector assembly according to the invention includes terminals which are placed and fixed in the housing with the lances and have contact and retainer shoulder portions and a retainer which is placed in the housing to press the lances against the terminals and latches engaging the shoulders of the terminals, so that not only the terminals are fixed by the lances but also the lances are pressed by the retainer against the terminals while the latch of the retainer engages the shoulder of the terminal (double engagement), thus assuring firm fixation of the terminals.

The retainer has the wedge portion for pressing the lance against the terminal and the lance member for engaging the shoulder of the terminal so that when the two connectors are connected, the retainer is pushed into the connector housing while the wedge portion of the retainer presses the lance to the terminal thus assuring fixation of the terminals.

What is claimed is:

1. An electrical connector comprising:

a connector housing with a front retainer receiving cavity and a rear terminal receiving cavity having a lance;

a terminal with a lance shoulder placed in said terminal receiving cavity such that said lance shoulder engages said lance and having a retainer latch shoulder; and a retainer placed in said retainer receiving cavity and having a wedge member for urging said lance against said terminal and a latch projection for engaging said retainer latch shoulder of said terminal.

2. An electrical connector comprising:

a connector housing having front and rear faces, which includes a partition wall extending rearwardly from said front face to define at least one front retainer receiving cavity and having an end in said connector housing; at least one rear terminal receiving cavity extending forwardly from said rear face; and at least one lance extending diagonally forwardly from said end of said partition wall so as to form a space between said partition wall and said lance;

at least one terminal with a lance shoulder placed in said terminal receiving cavity such that said lance shoulder engages said lance and having a retainer latch shoulder; and a retainer placed in said retainer receiving cavity and having at least one wedge member placed in said space between said partition wall and said lance for urging said lance against said terminal and a latch projection for engaging said retainer latch shoulder of said terminal to thereby provide a double engagement for said terminal.

* * * * *